United States Patent [19]

Parsons et al.

[11] 4,075,758

[45] Feb. 28, 1978

[54] METHOD FOR TERMINATING SHEATH COVERED CABLE AND FOR PROVIDING A WIRING SYSTEM

[75] Inventors: Stuart L. Parsons, Belleair Beach, Fla.; George Henry Vigeant, deceased, late of St. Petersburg, Fla., by Mrs. George Henry Vigeant, heir

[73] Assignee: AMP Incorporated, Harrisburg, Pa.

[21] Appl. No.: 717,820

[22] Filed: Aug. 26, 1976

Related U.S. Application Data

[63] Continuation of Ser. No. 337,513, March 2, 1973, abandoned, which is a continuation-in-part of Ser. No. 84,009, Oct. 26, 1970, abandoned.

[51] Int. Cl.[2] ..... H01R 43/00

[52] U.S. Cl. ..... 29/628; 29/630 A; 339/99 R

[58] Field of Search ..... 339/97, 98, 99; 29/628, 29/629, 630 R, 630 A

[56] References Cited

U.S. PATENT DOCUMENTS

| | | | |
|---|---|---|---|
| 2,162,545 | 6/1939 | Benander et al. | 339/99 R |
| 2,333,266 | 11/1943 | Miller | 339/95 R |
| 2,892,174 | 6/1959 | Benander | 339/99 R |
| 3,167,375 | 1/1965 | Sarazen | 339/99 R |
| 3,444,506 | 5/1969 | Wedekind | 339/99 R |
| 3,723,948 | 3/1973 | Wyatt | 339/99 R |

*Primary Examiner*—Victor A. DiPalma
*Attorney, Agent, or Firm*—Gerald K. Kita

[57] ABSTRACT

A method for terminating cable having a plurality of individually insulated conductors covered by a sheath, first by slitting or removing slices of the sheath to expose lengths of said conductors, then spreading apart the conductors laterally from each other, precisely locating the spread apart conductors in a desired lateral adjacent spaced relationship, then electrically connection an electrical terminal to each of the conductors. Such terminals are either sequentially or simultaneously connected to the conductors. The terminals may be of the insulation piercing type. Alternatively, the individual conductors may be stripped and terminated with terminals which need not be of the insulation piercing type.

4 Claims, 19 Drawing Figures

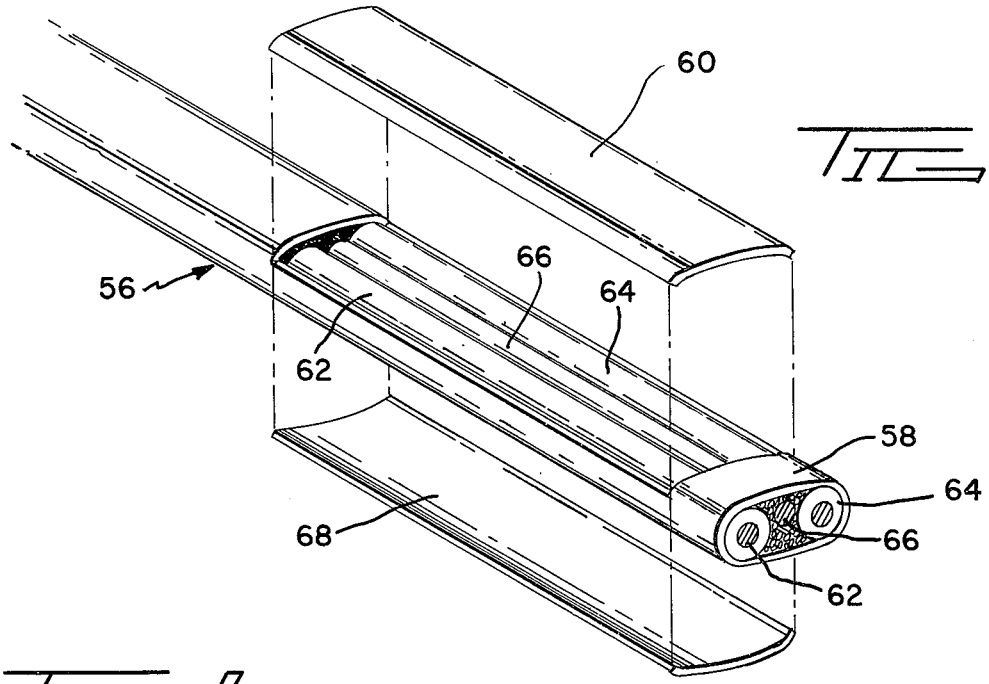
FIG. 7
FIG. 8
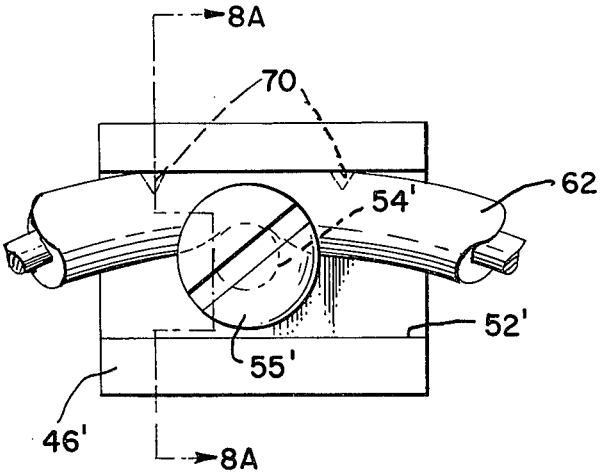
FIG. 8A
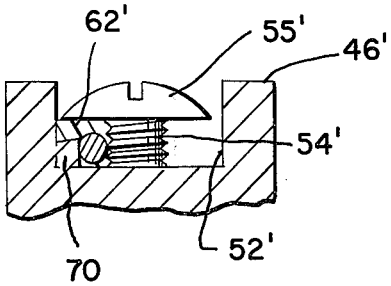
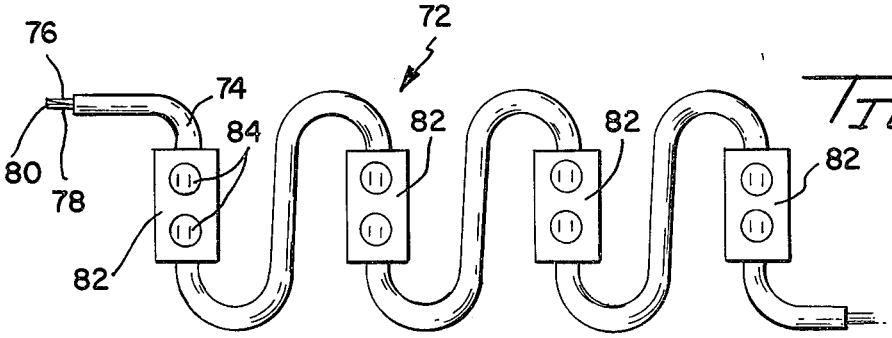
FIG. 9

110
116
28A
20
112
118
2
24
10
1
22
6
116
36A
114
1
116
6
114
36A
114
1
6
36A
36A
36A
1

METHOD FOR TERMINATING SHEATH COVERED CABLE AND FOR PROVIDING A WIRING SYSTEM

CROSS REFERENCE TO RELATED APPLICATION

This is a continuation, of application Ser. No. 337,513 filed Mar. 2, 1973, now abandoned, and which in turn is a continuation-in-part application of U.S. Pat. application Ser. No. 84,009, filed Oct. 26, 1970, and now abandoned.

FIELD OF THE INVENTION

The present invention relates generally to a method for terminating electrical cable having a plurality of individually insulated conductors covered by an outer insulation sheath. Additionally, the present invention relates to a method for connecting electrical terminals to individually insulated multi-conductor electrical cable without a need for severing individual conductors, with additional terminals successively applied to the cable in order to provide a wiring system.

BACKGROUND OF THE PRIOR ART

There has been a long existing need for a wiring method enabling a plurality of electrical receptacles, know as outlet receptacles, to be connected electrically in parallel along a single electrical cable. Heretofore, the cable individually insulated conductors were severed, the end of the severed conductors were stripped and then connected to input terminals of an outlet receptacle. Subsequently, the stripped conductor ends of another length of cable were individually terminated to the output terminals of the outlet receptacle. Such a process was repeated to provide successive outlet receptacles connected electrically in parallel and interposed between terminated lengths of electrical cable. However, the successively connected receptacles were not provided on a continuous length of electrical cable. Rather, the circuit path through the cable lengths was interrupted by the input and output terminations of each outlet receptacle thus interposed. Accordingly, if a termination of one of the receptacles was inferior or became faulty and interrupted the circuit paths, all of the subsequently provided receptacles would have been deprived of current flow. Alternatively stated, the circuit continuity through each outlet receptacle was dependent upon the structural integrity of all the terminations of every prior parallel connected receptacle. The possibility for a circuit failure thus was greatly increased upon each addition of a successively connected receptacle.

BRIEF DESCRIPTION OF THE PREFERRED EMBODIMENTS

The present invention eliminates the possibility that a single inferior termination of an outlet receptacle will adversely affect current flow to successively provided receptacles. According to the present invention, a plurality of electrically paralleled outlet or duplex receptacles are successively connected along a single length of electrical cable without a need for severing the individual conductors thereof. Thus a continuous electrical path is provided along an entire single length of cable, which path is not adversely interrupted by faulty terminations to duplex receptacles successively terminated along the cable length. According to the preferred embodiments to be hereinafter described in detail, the outer insulation sheath of a length of electrical cable is sliced to provide either slits or sliced away portions exposing portions of the individual conductors thereof. The individual conductors are then spread apart laterally from each other and then positioned in desired lateral spaced adjacent relationships. The thus positioned or located conductors are then engaged on correspondingly spaced electrical terminals. The terminals are then individually or simultaneously terminated to individual conductors. The terminals may advantageously be associated with receptacle outlets of a duplex type receptacle. The terminals may also be of the insulation piercing type which eliminates the need for stripping the individual insulation from the conductors. Alternatively, the terminals need not be of the insulation piercing type, in which case the individual conductors are first stripped prior to termination by the correspondingly spaced terminals.

OBJECTS OF THE INVENTION

It is therefore an object of the present invention to provide a method for connecting a plurality of duplex receptacles electrically in parallel and successively along a length of electrical cable without a need for severing the individual conductors of the cable.

Another object of the present invention is to provide a method for terminating a plurality of duplex receptacles successively in electrical parallel relationship along a length of electrical cable without a need for severing the individual cable conductors or stripping the individual insulation from the conductors prior to termination.

Yet another object of the present invention is to provide a method for individually terminating the insulated conductors of an electrical cable without a need for severing or stripping the insulation from the conductors.

A further object of the present invention is to provide a method for terminating the individual conductors of an electrical cable by slicing the cable insulation sheath, spreading apart the adjacent individual conductors of the cable and positioning the conductors in lateral spaced relationship for electrical connection thereof to correspondingly spaced electrical terminals.

Yet another object of the present invention is to provide a method for individually terminating the insulated conductors of an electrical cable by first slicing away the cable insulation sheath to expose lengths of adjacent individual conductors thereof, spreading apart the individual conductors and locating them in a desired lateral spaced relationship, positioning the thus located conductors on terminals correspondingly laterally spaced, and electrically connecting the conductors either simultaneously or sequentially to the respective terminals.

Other objects and many attendant advantages of the present invention will become apparent upon perusal of the following detailed description taken in conjunction with the accompanying drawings.

BRIEF DESCRIPTION OF THE DRAWINGS

FIG. 7 is a modification of the embodiment shown in FIG. 2 and further illustrating an outer insulation sheath of the electrical cable sliced away rather than slitted in order to expose the individual conductors of the cable;

FIG. 8 is a fragmentary plan view of a modification of the electrical terminal shown in FIG. 6, with the modified terminal provided with insulation piercing lances and an insulation piercing threaded fastener for terminating an unstripped length of insulated conductor;

FIG. 8A is a secion taken along the lines 8A—8A of FIG. 8;

FIG. 9 is a schematic of a wiring system with a plurality of duplex receptacles similar to that shown in FIG. 1 successively terminated to a length of electrical cable according to the method of the present invention;

DETAILED DESCRIPTION OF THE PREFERRED EMBODIMENTS

Figure 2:
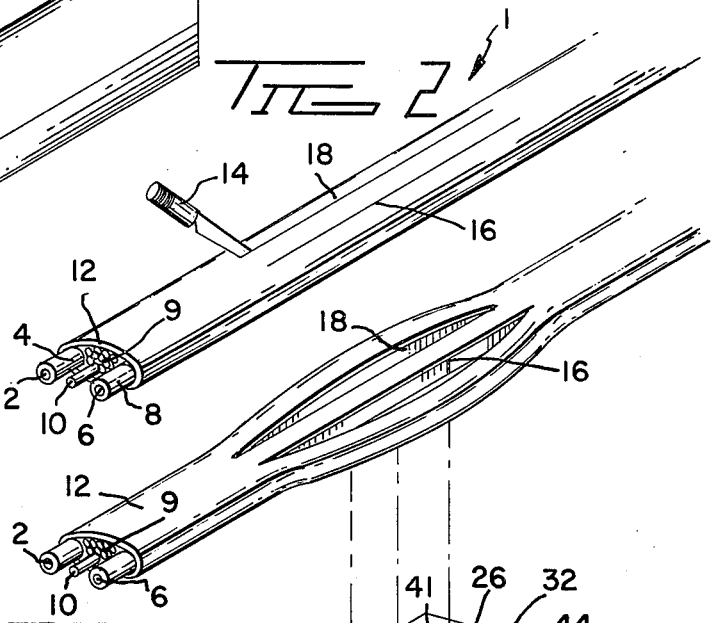
FIG. 2 is a perspective of a length of electrical cable enabling practice of a method step according to the present invention whereby slits are provided longitudinally of the outer insulation sheath of the electrical cable.

With more particular reference being made to FIG. 2 of the drawings, there is shown generally at 1, a length of electrical cable having a first electrical conductor 2 individually provided thereover with encircling insulation 4. In addition, a second electrical conductor 6 provided individually thereover with encircling insulation 8 is in parallel spaced relationship with respect to the conductor 2. Interposed between and parallel to the conductors 2 and 6 is a third conductor 10 which may be uninsulated, as is a common practice in electrical cables of the prior art. The conductors 2, 6 and 10 are provided longitudinally thereover with an encircling insulation sheath 12 as is the typical practice in existing electrical cables of the prior art.

According to existing practices, the cable includes a stuffing or filler material of insulation material, generally paper, rag, or similar material shown at 9, which is packed between the conductors 2, 6 and 10, and which provides an oval shape to the cross section of the cable. The filler material also slightly stiffens the cable to prevent it from being limp and fills the spaces between the conductors.

According to one preferred method of the present invention, the insulation sheath 12 is sliced longitudinally by a proper hand tool such as a knife, indicated generally at 14, for example. Thus such a slicing operation provides a slit 16 through the insulation sheath 12 and stuffing 9, and generally longitudinally between the insulated conductor 6 and the center uninsulated conductor 10. In similar fashion, a slit 18 is provided longitudinally in the insulation sheath 12, and between the insulated conductor 2 and the uninsulated conductor 10. One type of prior art electrical cable includes only a pair of insulated conductors such as the conductors 2 and 6 without a central conductor, such as the conductor 10. In such case, only one of the slits 16 or 18 is needed between the two insulated conductors. Another type includes more than three conductors, requiring a slit between each adjacent pair of conductors.

Figure 3:
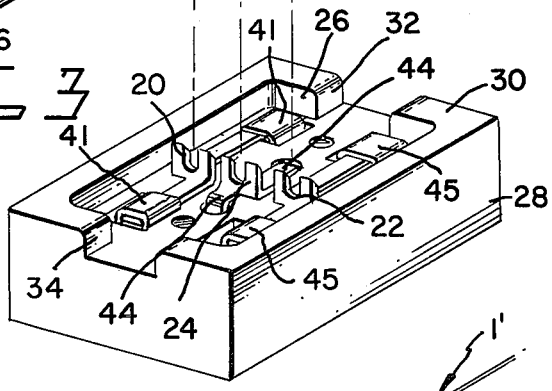
FIG. 3 is an exploded perspective of the electrical cable illustrated in FIG. 2 with the individual conductors thereof spread apart and located in a desired lateral spaced adjacent relationship with respect to each other for engagement on correspondingly laterally spaced electrical terminals advantageously mounted in a housing.

With reference to FIG. 3, portions of the conductors 2, 6 and 10 extending along the slits 16 and 18 are spread apart laterally from one another, either by hand or by use of a suitable tool, not shown. With the conductors in the condition, shown in FIG. 3, it is noted that the insulation layers 4 and 8 encircling the conductors 2 and 6, respectively, are not severed during the slicing process above described with reference to FIG. 2. Thus slicing the insulation sheath 12 and spreading apart the conductors 2, 6 and 10 from each other is accomplished without a need for severing the conductors or stripping away the insulation layers 4 and 8 thereof.

The filler material 9 and the outer sheath 12 have portions which are slitted and then spread apart together with the conductors 2, 6 and 10. With reference yet to FIG. 3, the spread apart conductors in the vicinity of the slits 16 and 18 are positioned in a desired lateral adjacent spaced relationship. More particularly, placement of the laterally spread apart conductors in the vicinity of the slits 16 and 18 may be selected to correspond exactly to the spacing between a plurality of of terminals 20, 22 and 24. Advantageously, the terminals may be located in a bottom wall of a recess 26 provided in a housing 28. For example, the housing 28 may include a portion of a duplex receptacle as will be described in detail. For example, the recess 26 is defined by an encircling sidewall 30 having openings 32 and 34 therethrough, which openings are in alignment with each other and are dimensioned to receive the cable 1 therethrough. With the laterally positioned portions of the conductors 2, 6, and 10 engaged against respective terminals 20, 22 and 24, a cover plate 36 is then engaged in overlying relationship against the spread apart portions of the conductors. Upon application of pressure to the cover plate 36, the conductors 2, 6 and 10 will be forcibly and simultaneously, electrically and mechanically connected to the respective terminals 20, 22 and 24. More specifically, each of the terminals is provided with a generally U-shaped notch 38 in which the conductors 2, 6 and 10 are forcibly inserted. During such insertion, the portions of the terminal 20 which are adjacent to the notch 38 will slice through the insulation 4 of the conductor 2 and will mechanically and electrically engage and grip the conductor 2. In similar fashion, the portions of the terminal 22 which are adjacent to its notch 38 will slice through the insulation 8 of the conductor 10 and will electrically contact and grip the conductor 10. Additionally, the portions of the terminal 24 adjacent to its notch 38 will mechanically and electrically engage and grip the uninsulated conductor 6 during such insertion thereof. Any filler material 9 or outer sheath 12 in the way of any of the terminals will be either pushed away or sliced through by the terminals upon insertion of the conductors into the terminals. Thus, by precisely locating portions of the conductors 2, 6 and 10 in lateral spaced relationship and by positioning such portions in engagement upon the terminals 20, 22 and 24 as described, the housing 28 and its cooperating cover plate 36 will be electrically connected onto a length of the cable 1 without a need for severing or stripping the insulation from the individual conductors, 2, 6 and 10 thereof. The cover plate 36 cooperates with the housing 28 to retain the cable 1 in position as shown in FIG. 1.

Since the conductor 10 is uninsulated, the terminal 24 does not slice through insulation before electrically engaging the conductor. Accordingly, it is contemplated that the conductors 6 and 8 may be stripped of their insulation before connection electrically to their terminals 20 and 22. If so, the terminals may still be utilized to electrically engage the conductors, similarly as the terminal 24 engages the uninsulated conductor 10.

Figure 1:
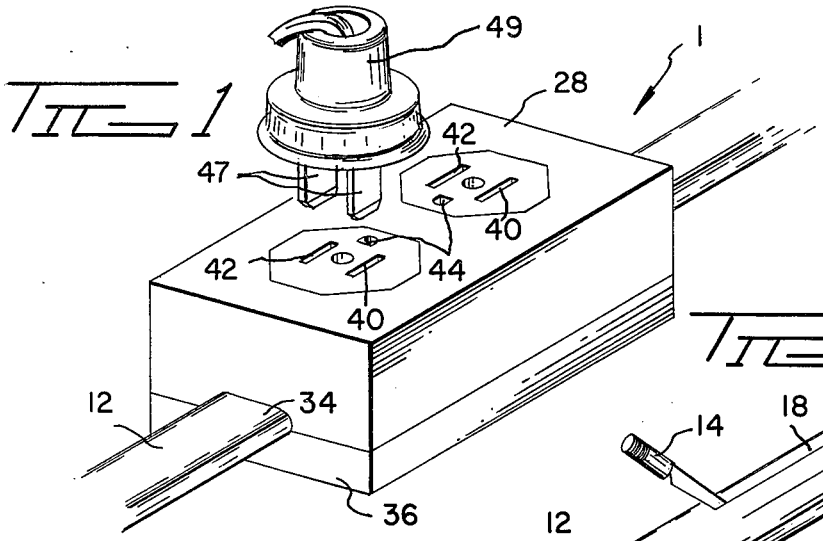
FIG. 1 is a perspective of a preferred embodiment of the present invention illustrating one exemplary duplex receptacle of a plurality of like receptacles successively connected electrically in parallel along a length of electrical cable according to the method of the present invention.

The perspective of FIG. 1 particularly shows that the housing 28, shown in a position inverted from its position shown in FIG. 3, may advantageously comprise a duplex receptacle housing provided with a cooperating cover plate 36.

Figure 4A:
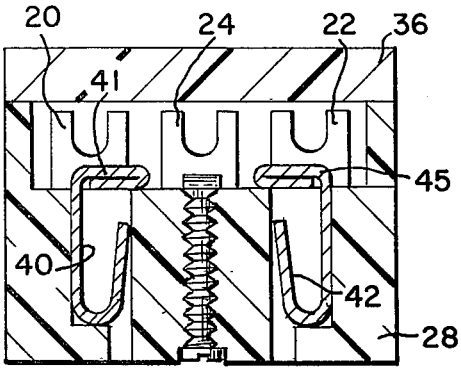
FIGS. 4 and 4A are fragmentary sections of the terminals and housing of FIG. 3 provided thereover with a cover plate which retains the individual conductors of the cable illustrated in FIG. 3 in electrical and mechanical engagement on the terminals.

As shown in FIGS. 1, 3 and 4A, the duplex receptacle housing includes a pair of contact portions 40, each in the form of an arcuate spring (FIG. 4A) connected to the contact 20 by a folded portion 41 integral with the electrical terminal 20. In similar fashion, the duplex receptacle housing includes a pair of contact portions 42, each in the form of an arcuate spring (FIG. 4A) connected to the contact 22 by a folded portion 45 integral with the electrical terminal 22. As shown more specifically in FIG. 1, the contact portions 40 and 42 are disposed in respective slotted portions of the duplex receptacle housing to receive a plug-in connection to the prongs 47 of the well-known plug 49 of an electrical appliance, lamp, machine, or the like.

Accordingly, the electrical terminal 20 terminated to the insulated conductor 2 as described will connect the duplex receptacle contact portions 40 electrically along the conductor 2. Similarly, the terminal 22 terminated to the conductor 10 will connect the duplex receptacle 42 electrically along the conductor 10. Accordingly, the receptacles 40 and 42 together form two electrical outlets connected electrically in parallel along the cable 1.

Figure 4:
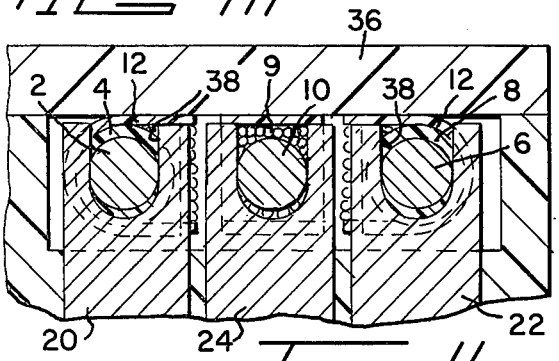
Figure 10:
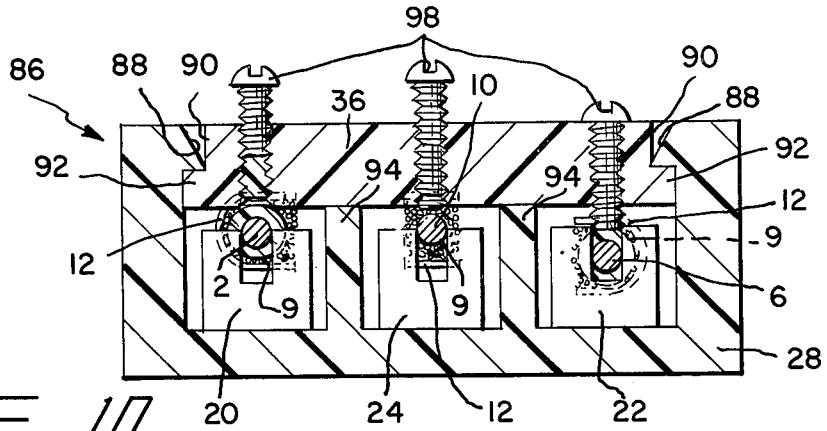
FIG. 10 is an enlarged section taken along the line 11—11 of FIG. 11.
Figure 11:
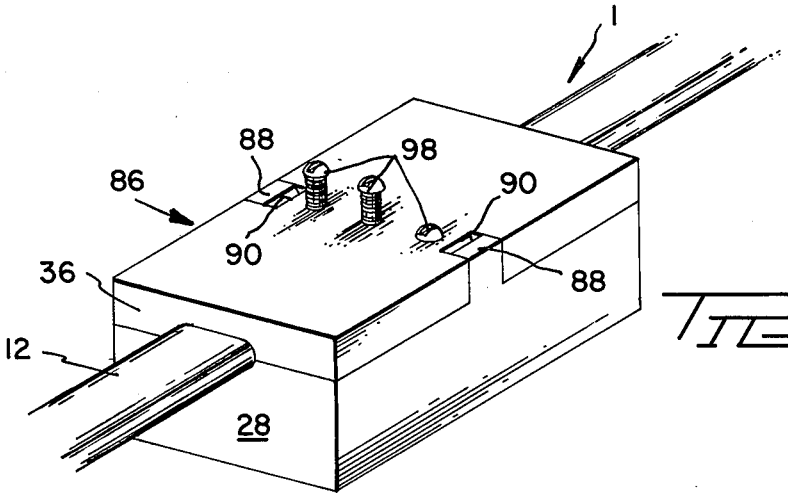
FIG. 11 is a fragmentary perspective of a modification of the duplex receptacle housing shown in FIGS. 1-4A, and further illustrating connection of the housing to an electrical cable.

With more particular reference to FIG. 10, a modification of the preferred embodiment describing conjunction of FIG. 1 will be described in detail. The modification illustrated generally at 86 includes the base portion 28 being additionally provided with opposed projecting hook portions 88 fabricated integral with the base portion 28. The cover 36 is modified with a pair of notch portions 90 corresponding in location to the hook portions 88. In operation, the spread apart conductors 2, 6 and 10 are located in their precisely aligned relationship with corresponding slicing type electrical contacts 20, 22 and 24 which may be identical with those hereinbefore described in conjunction with the preferred embodiment of FIG. 1. However, in the preferred embodiment of FIG. 10, the cover 36 is first placed in overlying relationship over the conductors which are aligned with the respective contacts 20, 22 and 24. The cover is then forcibly pressed against the conductors forcing them toward the slotted portions of the respective contacts until the shoulder portions 92, which are defined by the notched portions 90, are forced past the hook portions 88 of the base 28 and become latched under the hooked portions 88 as shown in FIG. 10. In this position, the cover 36 will also impinge against the ends 94 of partitions interposed between adjacent ones of the contacts 20, 22 and 24. At this point in time the conductors 2, 8 and 10 as well as the contact 20, 22 and 24 are enclosed within the dielectric housing formed by the base 28 and the cover 36 which is latched to the base. However, the conductors are not terminated or, more specifically, forced into electrical contact within the slotted portions of the contact 20, 22 and 24. Instead, the cover 36 is provided with dielectric screws 98 which are threadably secured in the cover 36. The screws are individually threadably driven by means of a screw driver tool to forcibly protrude from the cover 36 into the interior of the housing formed by the cooperating cover and base portion 28 so as to engage and forcibly urge corresponding ones of the conductors 2, 8 and 10 into the slotted portions of the corresponding contacts 20, 22, and 24. Thereby the individual conductors are forcibly inserted into the slotted portions of the corresponding contacts to make electrical connections therewith, similarly as described in conjunction with the preferred embodiment as illustrated in FIGS. 4 and 4A. As with the prior embodiment, any portions of the filler material 9 or the outer sheath 12 which are in the way of the contacts 20, 22 and 24 are either pushed away or sliced through by the contact as the corresponding conductors 2, 8 and 10 are forcibly inserted into the corresponding contacts to make electrical connections therewith. In other words, the filler material 9 or the insulation sheath 12 although not ever removed from the individual conductors do not prevent or other wise interfere with making electrical connections to the slicing type slotted electrical contacts as described. The all dielectric housing comprising the base portion 28 and the cover 36 may be utilized without a need for grounding the contacts to the now commonly used metal receptacle box. This eliminates any operation necessary for mounting a receptacle box behind or internally of the wall structure of a building prior to providing the duplex receptacles. The present invention thus eliminates substantial expenditures of time and labor by eliminating the need for installation of receptacle boxes. In addition, the device of FIG. 11 may be removed for repair or replacement by inserting a prying tool within the notch portions 80 and prying the hook portions 88 away from the cover 36. The cover is then permitted to be removed from the base portion 28, thereby allowing the base portion 28 to be removed together with the contacts 20, 22 and 24 from the conductors 2, 8 and 10. Since the conductors 2, 8 and 10 have not been severed, they are substantially unchanged to permit a replacement outlet receptacle to be then electrically connected to the unsevered and substantially undamaged conductors 2, 8 and 10. The receptacle housing of either FIG. 1 or FIG. 10 may be utilized as a replacement.

Figure 12:
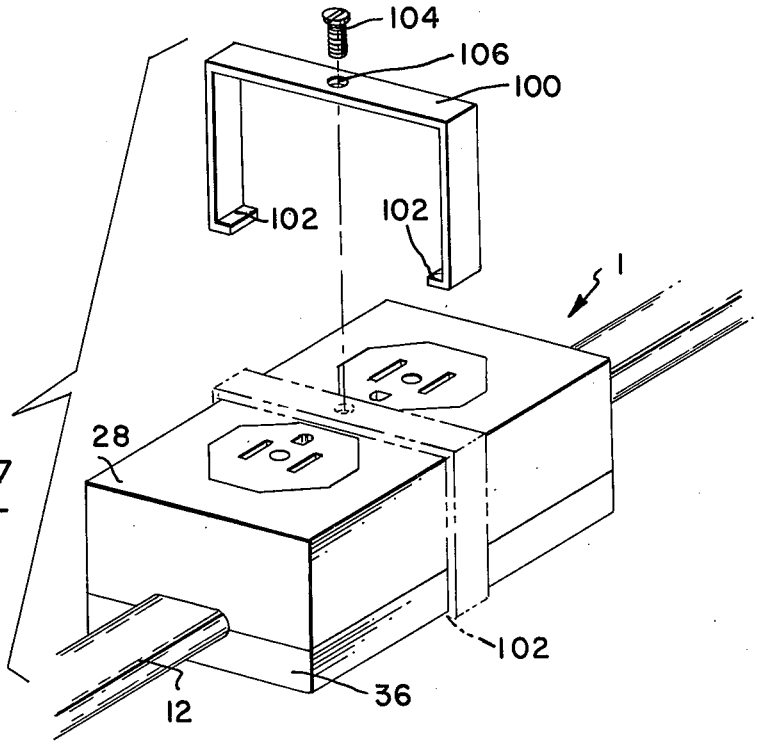
FIG. 12 is a fragmentary perspective of another modification of either of the duplex receptacle embodiments in FIGS. 1-4A and FIGS. 10-11, illustrating a grounding strap.
Figure 13:
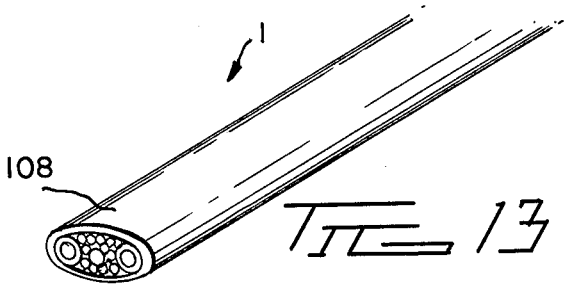
FIGS. 13-16 are fragmentary enlarged perspectives illustrating the sequential steps of an alternate cable preparation according to the present invention.

In FIG. 12, there is shown another modification of the preferred embodiments illustrated in either FIGS. 1 or FIG. 10. The housing including the base portion 28 and the cooperating cover 36, which may be connected electrically to the electrical cable 1 as described either in conjunction with the embodiments of FIGS. 1 or 10. Thus, the cooperating base portion 28 and the cover 36 once connected in cooperating relationship as shown in either FIGS. 1, 11, or 12, may be further provided thereover with a metal strap 100 generally of U-shaped configuration having hook end portions 102. The strap is slipped in partially encircling relationship over the base portion 28 with the hook portions 102 engaged over the cover 36 as shown in phantom outline in order to assist in retaining the base portion and cover together in cooperating relationship. A metal screw 104 is then threadably inserted into the correspondingly threaded aperture 106 of the strap and threadably driven to protrude internally of base portion 28 into engagement with the central electrical contact 24. Since the screw 104 is metal, it electrically grounds the metal strap 100 to the contact 24.

Figure 5:
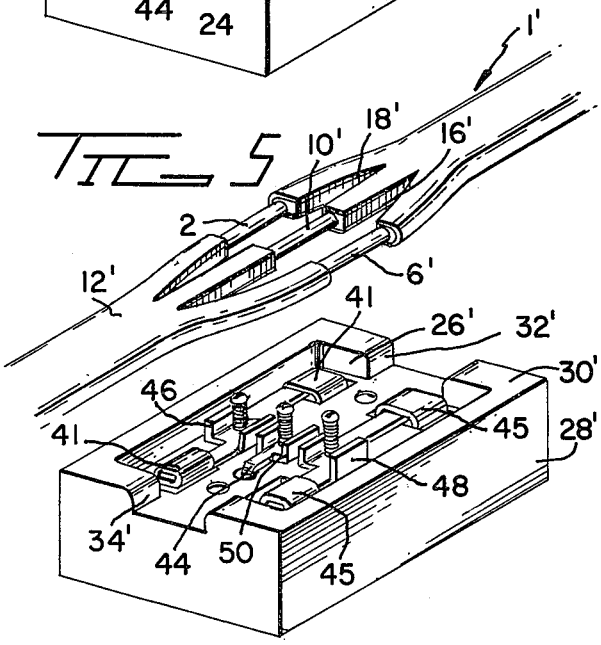
FIG. 5 is a modification of the embodiment shown in FIG. 3 enabling practice of an alternative method according to the present invention whereby the individual conductors of an electrical cable are stripped and located in adjacent spaced relationship prior to electrical connection to correspondingly laterally spaced electrical terminals.
Figure 6:
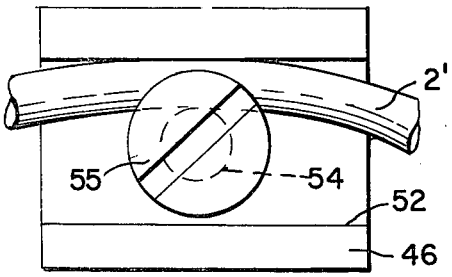
FIG. 6 is a fragmentary plan view of a selected electrical terminal shown in FIG. 5 electrically connected to a conductor of the cable shown in FIG. 5.

An alternative method for connecting a modified duplex receptacle housing will be described with reference to FIGS. 5 and 6. Thus, an electrical cable 1' similar to the cable 1 as shown in FIG. 2, is provided with laterally spread apart portions of conductors 2', 6' and 10' which are similar to the conductors 2, 6 and 10 of FIG. 2. As shown in FIG. 5, the spread apart portions of the conductors 2', 6' and 10' are stripped of their surrounding filler material 9 and insulation sheath 12. Further, the spread apart portions of the conductors 2' and 6' are stripped of their surrounding insulation layers. The conductors are spread apart and positioned to correspond to the lateral spacings of electrical terminals 46, 48 and 50. The cable 1' is placed in the recess 26' of the housing 28' with the stripped conductors 2', 6' and 10' respectively engaged on the terminals 46, 48 and 50. With reference to FIG. 6, the exemplary terminal 46 is shown with a channel 52 extending longitudinally of the stripped portion of the conductor 2', which conductor is received in the channel adjacent to a threaded fastener 54 threadably secured in the channel 52. The enlarged head 55 of the fastener overlies and compresses and retains the conductor 2' in electrical and mechanical engagement with the terminal 46.

The remaining terminals 48 and 50 are of similar construction and are terminated respectively to the stripped portion of the conductors 6' and 10' by a threaded fastener as described in conjunction with FIG. 6. To complete the assembly, a cover plate (not shown) similar to the cover plate 36 cooperates with the housing 28' to enclose the cable 1' within the recess 26' of the housing. For example, the housing 28' may comprise a duplex receptacle similar to that shown in FIG. 1, with the terminals 46, 48 and 50 connected to the outlet receptacle of the duplex housing in a manner similar to that described with respect to the terminals 20, 22 and 24 of FIG. 3.

With more particular reference being made to FIG. 7, a modification of the electrical cable shown in FIG. 2, 3 and 5 will be described in detail in order to more fully explain an alternative method according to the present invention. Thus, there is generally shown at 56 in FIG. 7 a length of electrical cable similar to the cable 1 shown in FIG. 2. In practice of the alternative method, the outer insulation sheath 58 is sliced longitudinally thereof to form a sliced portion 60 of the sheath 58, which is removed in order to expose longitudinal parallel adjacent portions of the conductors 62, 64 and 66 which are similar to the conductors 2, 6 and 10 of FIG. 2. In addition, a like longitudinal sliced portion 68 is removed from the sheath 58 on a side thereof opposite to the removed sliced away portion 60. Accordingly, the longitudinal portions of the conductors 62, 64 and 66 are exposed through opposed sides of the insulation sheath 58. The conductors 62, 64 and 66 may then by spread apart by use of a suitable tool or by hand in lateral spaced adjacent relationship for termination to correspondingly spaced terminals. More paticularly, the electrical conductors of the embodiment shown in FIG. 7 may be laterally spaced apart and terminated to the terminals 20, 22 and 24 as described in conjunction with FIG. 3. Alternatively, the exposed portions of the conductors 62 and 64 may be stripped and terminated to the terminals 46 and 48 as described in conjunction with FIG. 5. Thus, the modified cable 56 may be substituted for either of the cables 1 or 1' for electrical connection in either of the housings 28 and 28'.

In another embodiment of the present invention for practicing an alternative method according to the present invention, reference will be made to FIG. 8. Accordingly, a terminal 46' similar to the terminal 46 of FIG. 6 is shown in detail. The terminal includes a channel portion 52' extending longitudinally thereof and receiving the unstripped exposed portion of the conductor 62 of the electrical cable 56. The conductor 62, with its insulation still intact, is placed longitudinally in the channel 52' of the electrical terminal 46' and adjacent to the threaded fastener 54' which is centrally of the channel 52' and corresponding in configuration to the threaded fastener 54 of FIG. 6. As the fastener 54' is threadably tightened, the enlarged head 55' thereof will engage on the conductor 62 retaining it in place within the channel 52'. Additionally, the engaging head 55' will impinge the conductor 62 against a plurality of insulation piercing teeth 70 projecting into the channel 52'. Any number of such teeth 70 may be utilized although only two are shown, spaced apart and with the fastener 54' located generally equal distance therebetween. Additionally, the threaded fastener itself will pierce the insulation and contact the conductor 62. Also, a washer, provided with teeth 71 may be forced to pierce the insulation and contact the conductor 62. In similar fashion, each of the other conductors 64 and 66 of the cable 56 may be terminated to a terminal similar to the terminal 46' in a manner as described. For example, the terminal 46', as well as the other like terminals associated with the conductors 64 and 66, amy be substituted for the terminals 46, 48 and 50 of the housing 26'. Accordingly, with such terminals substituted, either of the cables 1 or 56 may be substituted for the cable 1' and terminated within the thus modified housing 28'. Thus, substitution of the terminals similar to that shown in FIG. 8 for the terminals 46, 48 and 50, modifies the housing 28' enabling it to be electrically connected to the cables 1 or 56 without a need for stripping the individual insulation from the insulated conductors of such cables.

Thus, the method according to the present invention may be practiced by slicing the outer sheath of an electrical cable to provide slits of sliced portions which are removed to expose longitudinal portions of the individual cable conductors, laterally spreading apart the individual conductors, and then locating them in desired laterally spaced adjacent relationships corresponding to the lateral spacing of corresponding electrical terminals. The conductors may then be simultaneously or individually electrically connected to the terminals. In addition, the spread apart portions of the conductors may first be stripped of insulation before connection to respective terminals. Other modifications and embodiments of the present invention will become apparent from the scope of the appended claims. For example, any of the insulation piercing techniques shown in FIGS. 8 and 8A may be used individually or in combination.

As shown in FIG. 9, there is shown a wiring system resulting from practice of the alternative method according to the invention. Such a system is generally indicated at 72 in FIG. 9, with an electrical cable 74, similar to the cables 1, 1' or 56 as described. In the system, a pair of conductors 76 and 78 corresponding to the pair of individually insulated conductors of the above described cables 1, 1' or 56 provides a current flow path. A central uninsulated conductor 80 between the conductors 76 and 78 provides a common potential or ground potential as typically required of existing wiring sytems. A plurality of duplex receptacles 82 are successively provided along the cable 74 according to any of the alternative methods as described hereinabove. Thus, the receptacles, as well as the pair of receptacle outlets 84 thereof, are connected electrically in parallel along the cable 74 of the wiring system without a need for severing or stripping the individual conductors of the cable 74. Thus, electrical continuity of any of the duplex receptacles 82 is not dependent upon the successive prior terminations to the cable 74 of the prior duplex receptacles.

Figure 14:
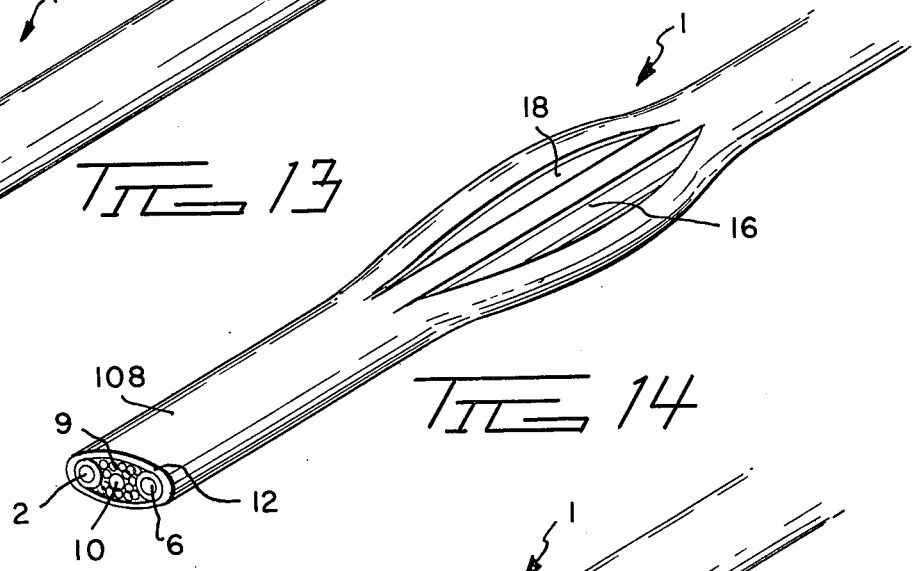
Figure 15:
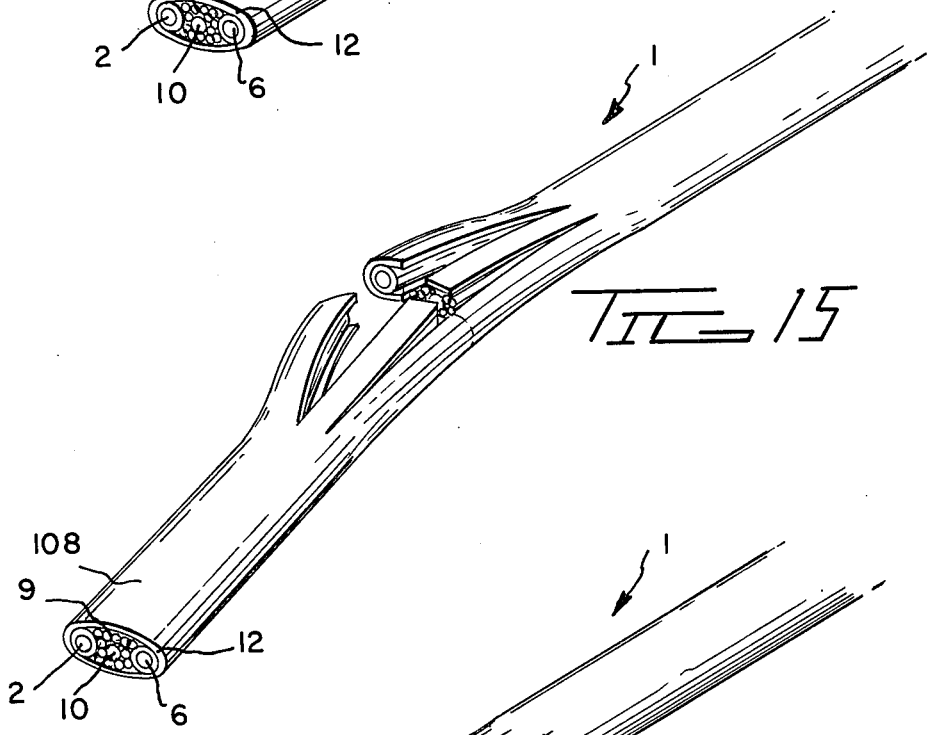
Figure 16:
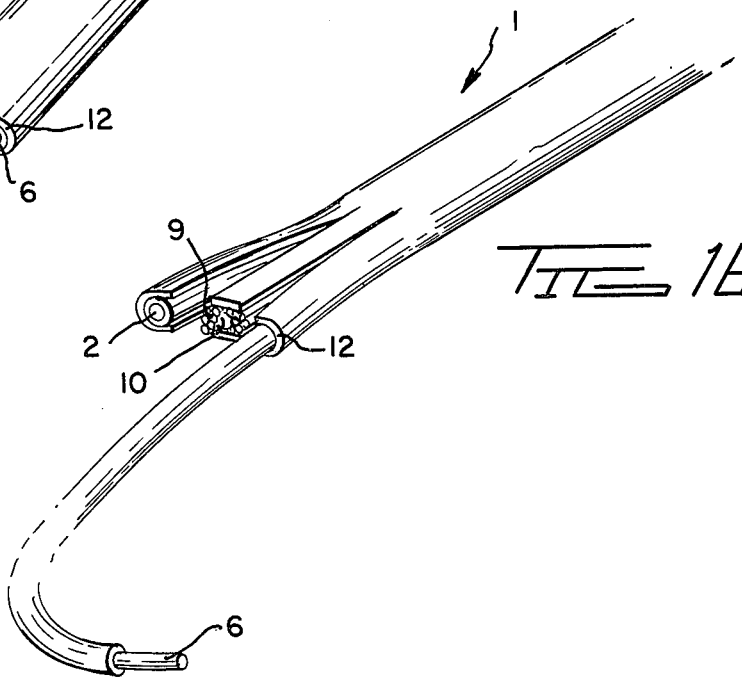
Figure 17:
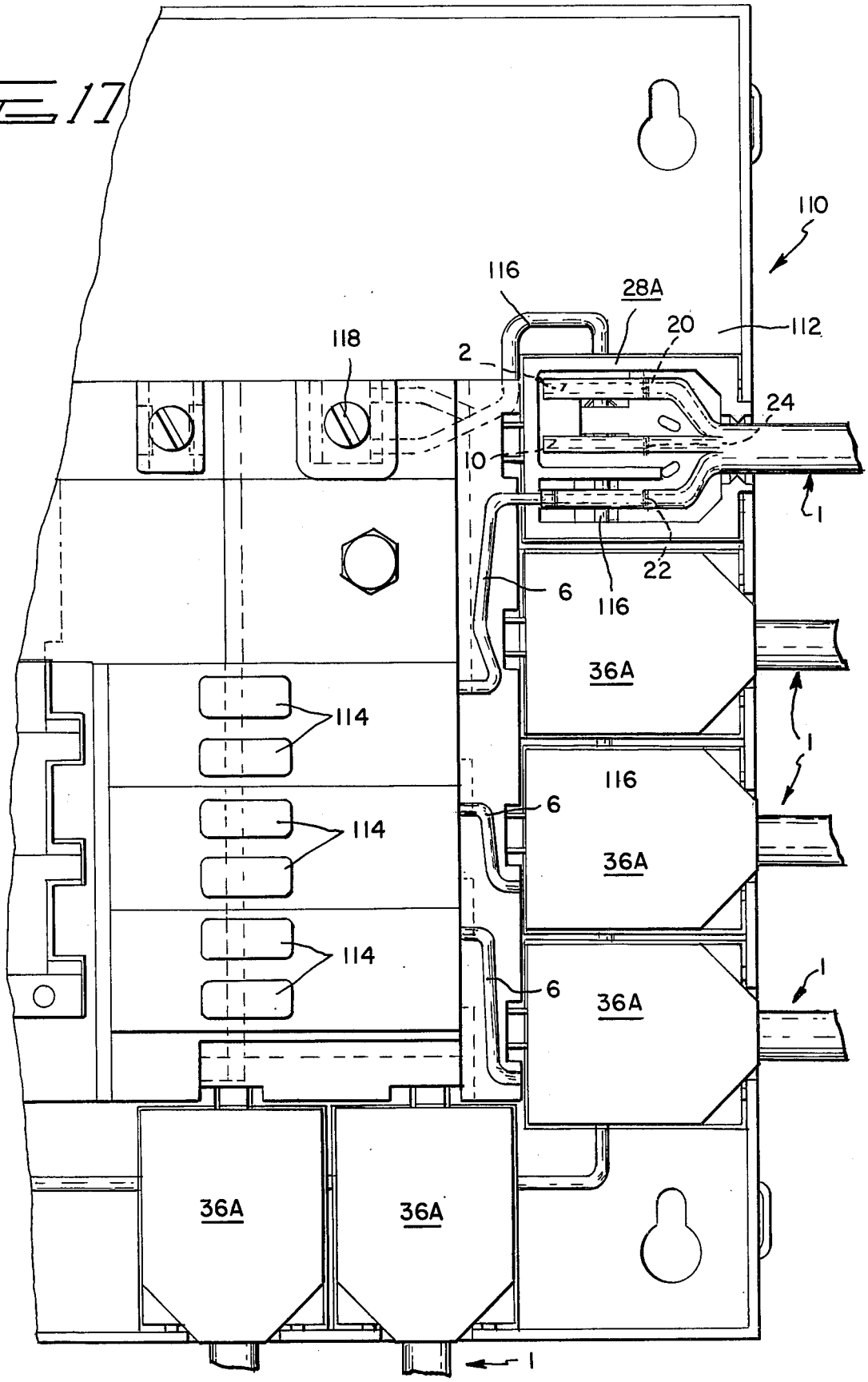
FIG. 17 is a fragmentary plan of a circuit breaker box receiving modified dieelectric housings and cables individually connected in perspective housings subsequent to cable preparation as illustrated in FIGS. 13-16.

With more particular reference to FIGS. 13—17, another preferred embodiment of the present invention will be described in detail. As shown in FIGS. 14 through 16, the cable 1 has an end portion 108 thereof which may be sliced through longitudinally adjacent the end portion 108 in order to spread apart portions of the individual conductors 2, 6 and 10 in a manner as heretofore described. The sliced portions 16 and 18 accordingly allow for lateral spreading out or separation of the individual conductors without severing them. As shown in FIG. 15, two of the conductors such as the conductors 2 and 10 are severed at their spread apart locations, while the remaining insulation covered conductor 6 remains unsevered. As a final step in cable preparation, the insulation outer sheath 12 is cut away from the remaining conductor 6 leaving a substantial length of the end portion of the conductor 6 yet attached to the rest of the cable 1. As shown in FIG. 16, the prepared cable will have its three conductors 2, 6 and 10 in relative spread apart conditions with one of the insulation covered conductors 6 being of longer lengths than the remaining conductors. As shown in FIG. 17, the prepared cable which is illustrated in FIG. 16 may be electrically connected to a circuit breaker assembly generally illustrated at 110 in FIG. 17. The circuit breaker box includes the outer housing 112 of metal having generally centrally of the box of a plurality of well-known circuit breaker type switches 114. More specifically, the cable 1 as prepared in FIG. 16 is placed within a modified housing 28A which is similar to the housing 28 as described in the previous embodiments, but modified so as to fit within the circuit breaker box. As in the previous embodiments, the individual conductors 2, 6 and 10 in their spread apart conditions are placed in overlying relationship over insulation slicing type contacts 20, 22 and 24 which may be the same type of contacts described in conjunction with the previous embodiments. The modified cover 36A of dielectric material is similar to the cover 36 of the previous embodiments, but modified in its shape so as to fit within circuit breaker box. The modified cover 36A is then used to overly the conductors 2, 6 and 10 and to forcibly press and thereby insert the conductors 2, 6 and 10 into the slotted portions of the respective contacts 20, 22 and 24 to make respective electrical connections therewith. The modified cover 36A cooperates with the modified housing 28A to enclose the connections and thereby enclose individual conductors 2, 6 and 10 and the contacts 20, 22, 24 internally of the dielectric housing formed by the cooperating cover 36A and base 28A. The remaining electrical conductor 6 which is of longer length than the rest of the conductors 2 and 10 protrudes from the housing as shown in FIG. 17 and is utilized to connect electrically to an appropriate one of the circuit breaker switches 114 in any well-known manner. In like manner a plurality of cable end portions which are similar to the cable end portion 108 can be suitably prepared with a configuration such as that shown in FIG. 16, and then electrically connected separately to other remaining positions within the circuit breaker box for enclosure by corresponding cover portions 36A and housing portions 28A. The individual conductors 6 of the additional cables which are longer in length than the remaining conductors of each cable may then be separately connected to a corresponding circuit breaker switch in any well-known manner of electrical termination. Thus, for each cable 1, a corresponding electrical terminal, 24 connected to the central or ground conductor 10 provides a ground electrical connection in a circuit breaker box. The conductors 2 of the corresponding cables 1 are connected to respective electrical terminals 20 which are bussed to an input conductor illustrated at 116 which is connected to the input terminal 118 commonly provided on the circuit breaker box. The individual conductors 6 which are longer than the remaining conductors of each cable are terminated to a corresponding circuit breaker switch 114. In such manner, the electrical cables 1 when prepared according to the method steps as shown in FIG. 14–16, thereby are well-adapted for electrical termination within a circuit breaker box, the function and operation of which occurs according to any prior art circuit breaker box device. As in all other terminations, any portions of the outer sheath 12 or the filler material 9 which is in the way of the terminals 20, 22, or 24 of each circuit box housing 28A, are either pushed away or sliced through during insertion of the corresponding conductor within the respective terminal, thereby preventing the presence of the outer sheath 12 and filler material 9 from interferring with the electrical connections to be made to the corresponding conductors. Each cable 1 as connected in the circuit breaker box 110 may therefore be provided therealong with electrically parallel connected duplex receptacles of the types which are specifically disclosed in the preferred embodiments according to the present invention. Thus, the present invention teaches not only the addition of duplex receptacles to electrical cables, but also teaches a method for preparing an end portion of the cable for termination within a circuit breaker box the specific details of which are described in conjunction with FIG. 17.

What is claimed is:

1. In a method for preparing a sheath covered three conductor cable, including two outer conductors individually covered with insulation and a centrally located uninsulated ground conductor, for assembly with electrical terminals contained in a housing, the improvement comprising the steps of:

piercing said sheath on opposite sides of said ground conductor, slicing entirely through said cable intermediate the ends thereof and longitudinally on both sides of said ground conductor and between said ground conductor and each of said insulation covered conductors to divide said sheath into longitudinal slitted portions overlying said conductors, spreading apart said insulation covered conductors laterally from said ground conductor while maintaining said slitted portions of said sheath over said insulation covered conductors, locating said ground conductor and said spread apart insulation covered conductors together with said slitted portions of said sheath over corresponding electrical terminals in said housing, with said conductors and with said outer sheath extending uninterrupted from one open end of said housing to another open end thereof, forcibly inserting said spread apart conductors together with said slitted portions of said sheath in between two slicing edges of corresponding spaced apart electrical terminals, thereby forcing the slicing edges to slice through the slitted portions of said sheath and the insulation covering said outer conductors, resulting in a high speed termination of said three conductor cable without interrupting either the conductors or the outer sheath.

2. In the method for terminating a sheath covered conductor cable, having two outer conductors individually covered with insulation and a centrally located uninsulated ground conductor, with said conductors being forcibly inserted between slicing edges of corresponding electrical contacts contained in a prong receiving electrical outlet housing, the improvement comprising the steps of:

slicing entirely through said cable intermediate the ends thereof in two locations longitudinally on both sides of said ground conductor and between said ground conductor and each of said outer conductors, said sheath and filler material packed inside said sheath and in between said ground conductor and said outer conductors both being divided into longitudinal slitted portions intermediate the ends of said cable, spreading apart portions of said insulation covered outer conductors together with corresponding slitted portions of said sheath and said filler material laterally away from said ground conductor and corresponding slitted portions of said sheath which are on opposite sides of said ground conductor, locating said spread apart conductors and said slitted portions of said sheath and said filler material in said housing with said cable sheath, filler material and conductors extending uninterrupted from one open end of said housing to another open end thereof, forcibly inserting said spread apart conductors and said ground conductor simultaneously in between said slicing edges of corresponding electrical contacts, forcing said terminals to slice through or push away said sheath and said filler material for penetration through the insulation covering said outer conductors and for gripped electrical engagement with said outer conductors and said ground conductor, thereby terminating said three conductor cable with an outlet receptacle housing at high speed without severing or removing any portions of said cable.

3. The method as recited in claim 2 and further including the steps of:

impinging a cover against said slitted portions of said cable and displacing said cover toward said housing to forcibly insert said conductors in between said slicing edges of said contacts, and latchably securing said cover on said housing and retaining said cover engaged against said slitted portions of said cable to retain said conductors in between the slicing edges of said contacts.

4. The method as recited in claim 2, and further including the steps of: providing a separate housing containing a plurality of electrical terminals at each of selected intervals along said cable sheath, and electrically and mechanically connecting said spread apart portions of said insulation covered conductors to corresponding electrical terminals contained within corresponding housings, and electrically connecting said ground conductor to corresponding electrical terminals contained in corresponding housings, whereby said housings are located at intervals along said cable sheath with the electrical terminals of said housings electrically connected to said insulation covered conductors and said centrally disposed ground conductor at said intervals along said cable sheath.

* * * * *